US006971924B2

(12) United States Patent
Fujita

(10) Patent No.: US 6,971,924 B2
(45) Date of Patent: Dec. 6, 2005

(54) CAP-FITTED AUXILIARY CONNECTOR FOR DIVIDED CONNECTOR AND A METHOD OF ASSEMBLING SUCH A CONNECTOR

(75) Inventor: Shinya Fujita, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/849,456

(22) Filed: May 19, 2004

(65) Prior Publication Data

US 2004/0235365 A1 Nov. 25, 2004

(30) Foreign Application Priority Data

May 20, 2003 (JP) ..... 2003/141586

(51) Int. Cl.[7] ..... H01R 13/514

(52) U.S. Cl. ..... 439/752; 439/701

(58) Field of Search ..... 439/701, 712, 439/752

(56) References Cited

U.S. PATENT DOCUMENTS

| | | | | |
|---|---|---|---|---|
| 5,286,225 | A * | 2/1994 | Tsuji | 439/752 |
| 5,643,015 | A * | 7/1997 | Wakata | 439/701 |
| 6,582,256 | B2 * | 6/2003 | Sakurai et al. | 439/701 |
| 6,666,730 | B2 * | 12/2003 | Canuto et al. | 439/752 |
| 6,814,627 | B2 * | 11/2004 | Yamamoto et al. | 439/701 |

FOREIGN PATENT DOCUMENTS

| | | |
|---|---|---|
| JP | 9-219238 | 8/1999 |

* cited by examiner

*Primary Examiner*—Briggitte R. Hammond
(74) *Attorney, Agent, or Firm*—Gerald E. Hespos; Anthony J. Casella

(57) ABSTRACT

A male terminal fitting (10) provided with a tab (11) is insertable into an auxiliary housing (20) from behind. A protection cap (30) capable of protecting the tab (11) by surrounding it is mounted on the auxiliary housing (20), thereby constructing a cap-fitted auxiliary connector (SC). The protection cap (30) is provided with front-stops (36) for holding the male terminal fitting (10) at its proper insertion position so as not move any further forward by being engaged with the male terminal fitting (10) inserted into the auxiliary housing (20).

11 Claims, 6 Drawing Sheets

CAP-FITTED AUXILIARY CONNECTOR FOR DIVIDED CONNECTOR AND A METHOD OF ASSEMBLING SUCH A CONNECTOR

BACKGROUND OF THE INVENTION

1. Field of the Invention

The invention relates to a cap-fitted auxiliary connector for a divided connector and to a method of assembling such a cap-fitted connector.

2. Description of the Related Art

Japanese Unexamined Patent Publication No. H09-219238 discloses a divided connector assembled by mounting auxiliary connectors into frames. More particularly, a male divided connector has a plurality of male auxiliary housings mounted in a male frame. The male frame is formed with a receptacle. Male terminal fittings are inserted in the male auxiliary housings and have tabs that project into the receptacle. A female divided connector is assembled similarly and can fit into the receptacle of the male frame. Thus, the male terminal fittings that project into the receptacle connect electrically with corresponding female terminal fittings of the female divided connector.

Male and female terminal fittings of divided connectors generally need to be engaged over a longer distance than in normal connectors in view of shaking that can occur between a frame and auxiliary housings. Accordingly, the tabs of male terminal fittings for male divided connectors are longer than the tabs of male terminal fittings for normal connectors.

Production and inventory cost could be reduced by using the same male terminal fittings for both normal and divided connectors. However, this would require insertion positions of the male terminal fittings of divided connectors to be shifted forward because the lengths of the tabs are insufficient. Such an arrangement causes a problem because the male terminal fittings cannot be stopped at their front-end positions by the auxiliary housings. In other words, the male terminal fittings for divided connectors are stopped at their front-end positions by the engagement of base ends of the tabs with front-stops of the auxiliary housings. However, the insertion positions of the male terminal fittings for normal connectors are shifted forward. Therefore, base ends of their tabs project forward from the auxiliary housings, making it difficult to stop the male terminal fittings at their front-end positions by the auxiliary housings.

The invention was developed in view of the above problem and an object thereof is to stop male terminal fittings at their front end positions during the insertion of the male terminal fittings.

SUMMARY OF THE INVENTION

The invention relates to a divided connector with cap-fitted auxiliary connectors mounted into a frame. Each auxiliary connector has an auxiliary housing. Male terminal fittings provided are mounted in the auxiliary housings and a protection cap is mounted on the auxiliary housings. The protection cap at least partly surrounds and protects tabs of the male terminal fittings. The protection cap comprises front-stops for engaging the male terminal fittings inserted into the auxiliary housings to hold the male terminal fittings at their proper insertion positions so as not to move any further forward.

The male terminal fittings are inserted while the protection cap is mounted on the auxiliary. Thus, the auxiliary housings can be transported to a site for assembling with the frame while the protection cap is mounted thereon, and the tabs of the male terminal fittings are protected during transit. The auxiliary housings are detached from the protection cap after transportation and are mounted into the frame to assemble the divided connector.

Front-stops on the protection cap engage the male terminal fittings to hold the male terminal fittings at their proper insertion positions in the auxiliary housings and to prevent further forward movement in the inserting direction. The tabs of male terminal fittings for a normal connector are shorter than the tabs of male terminal fittings for a divided connector. As a result, the insertion positions of normal male terminal fittings are more forward and it is difficult for auxiliary housings to hold normal male terminal fittings at their front end positions. However, the male terminal fittings of the subject invention can be held at their front end positions during the insertion of the male terminal fittings.

Each auxiliary housing preferably has an auxiliary front-stop for engaging the male terminal fitting and preventing the male terminal fitting from coming out forward. The auxiliary front-stops prevent the male terminal fittings from coming out forward even if the protection cap is detached from the auxiliary housings after the insertion of the male terminal fittings.

The cap preferably has at least one holding projection engageable with the auxiliary housing inserted to a substantially proper depth into the protection cap to hold the auxiliary housing so as not to come out.

The auxiliary housing preferably has a retainer for locking the male terminal fittings in the auxiliary housing.

A notch preferably is formed in the protection cap at a side corresponding to the retainer for permitting entry of the retainer.

The male terminal fitting preferably is accommodated in a cavity in the auxiliary housing and the front-stops bulge more inward than the inner peripheral surfaces of the cavity in the auxiliary housing. Thus, the male terminal fitting can be stopped at its front end position.

The male terminal fitting preferably comprises a main portion behind the tab with respect to an inserting direction. A base end of the tab is formed to gradually increase the height and/or width thereof toward the main portion.

Front-stops preferably can be engaged with the outer surfaces of the base end. Most preferably, the front-stops have a shape substantially conforming to the outer surfaces of the base end.

The invention also relates to a method of assembling a cap-fitted auxiliary connector for a divided connector. The method comprises providing a plurality of auxiliary housings to be mounted into a frame; mounting a protection cap onto at least part of the auxiliary housings; and inserting male terminal fittings into the auxiliary housing so that the protection cap surrounds and protects tabs of the male terminal fittings. The male terminal fittings are held at proper insertion positions so as not to move any further forward by engaging front-stops on the protection cap.

The step of mounting the protection cap and the step of inserting the terminal fittings may be performed in an arbitrary sequence in time.

The male terminal fitting preferably is engaged by an auxiliary front-stop on the auxiliary housing to prevent the male terminal fitting from coming out forward.

These and other objects, features and advantages of the present invention will become apparent upon reading of the following detailed description of preferred embodiments and accompanying drawings in which:

DETAILED DESCRIPTION OF THE PREFERRED EMBODIMENTS

Figure 1:
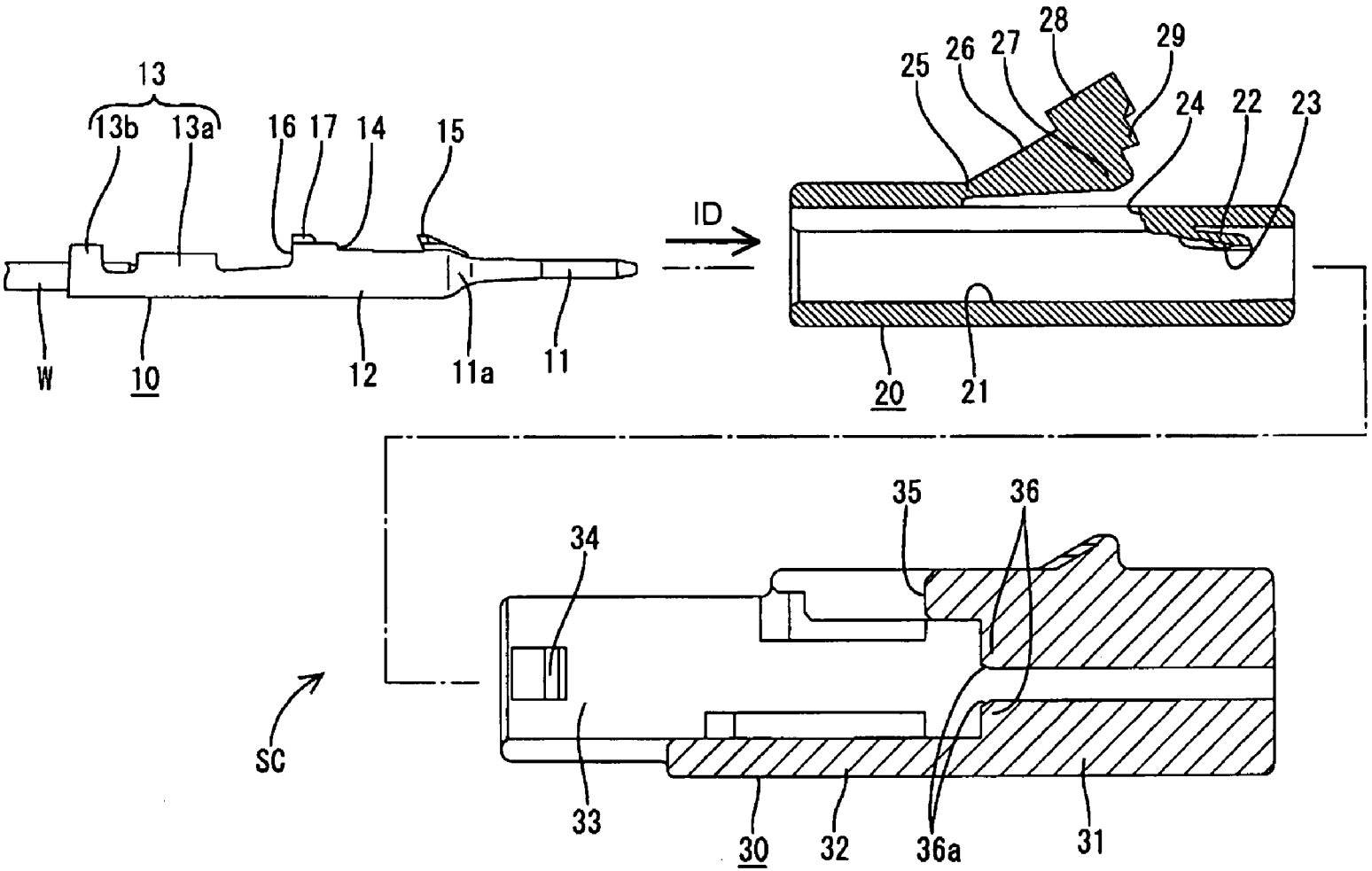
FIG. 1 is an exploded side view in section of a cap-fitted auxiliary connector according to one embodiment of the invention.

A cap-fitted auxiliary connector SC for a male divided connector MC according to the invention is shown in FIGS. 1 to 6 and is connectable with a female divided connector FC. The cap-fitted auxiliary connector SC, as shown in FIG. 1, has male terminal fitting 10 connected with ends of wires W. The male terminal fittings 10 are insertable along an inserting direction ID into an auxiliary housing 20, and a protection cap 30 is detachably mountable on the auxiliary housing 20. The auxiliary housings 20 are mounted into a frame 40 after the protection cap 30 is removed from the auxiliary housings 20 (see FIG. 5). The inserting direction ID direction of the male terminal fitting 10 into the auxiliary housing 20 and the withdrawing direction from the auxiliary housing 20 are referred to herein as forward and backward directions, respectively.

Each male terminal fitting 10 is press-formed of a conductive metallic plate and includes a tab 11, a box-shaped main portion 12 and a barrel 13 in this order from the front end. The tab 11 is electrically connectable with a mating female terminal fitting FT. The tab 11 extends longitudinally forward from the front edge of the main portion 12 and is formed by folding a plate piece along the longitudinal direction to bring folded sections into close contact. The tab 11 is shorter and narrower than the main portion 12. However, base end 11*a* of the tab 11 gradually increases in height and width towards the main portion 12, and the outer surfaces thereof are slanted or curved.

A recess 14 is formed substantially in the longitudinal middle of an outer surface of the main portion 12. The front edge of the recess 14 is embossed or cut and folded to project outward, thereby forming a locking projection 15 that is undercut or hanging over. A locking step 16 is formed at the rear end of the main portion 12 and a protrusion 17 is embossed on the locking step 16 to project up and out to substantially the same height as the locking projection 15. The barrel 13 includes two front crimping pieces 13*a* and two rear crimping pieces 13*b*. The front crimping pieces 13*a* are to be crimped, bent or folded into connection with a core of the wire W and the rear crimping pieces 13*b* are to be crimped, bent or folded into connection with an insulation coating of the wire W.

The male terminal fitting 10 is to be used for a normal connector (i.e. connector constructed by inserting a terminal fitting into a housing). Thus, the tab 11 is shorter than a conventional male terminal fitting (not shown) for a divided connector. Accordingly, an insertion position of the male terminal fitting 10 in the auxiliary housing 20 is more forward than the male terminal fitting for divided connector so that the front end of the tab 11 is substantially at the same position as the tab of the male terminal fitting for divided connector when the male terminal fitting 10 is inserted into the auxiliary housing 20.

The auxiliary housing 20 is made e.g. of a synthetic resin, and is in the form of a long narrow block. The auxiliary housing 20 is formed internally with at least one cavity 21, and the male terminal fitting 10 is insertable into the cavity 21 from behind. The base end 11*a* of the tab 11 projects forward from the auxiliary housing 20 when the male terminal fitting 10 is inserted to a proper depth in the cavity 21 (see FIG. 3). A lock 22 is cantilevered forward from an inner surface of a front part of the cavity 21 and is engageable with both the front edge of the recess 14 and the locking projection 15 of the male terminal fitting 10 that has been inserted to a proper insertion position. Thus, the lock 22 holds the male terminal fitting 10 so as not to come out backward. A projection insertion groove 23 is formed substantially in the widthwise middle of the inner part of the lock 22 for receiving the locking projection 15 of the male terminal fitting 10 and reducing a degree of resilient deformation of the lock 22 during the insertion of the male terminal fitting 10. Hence the auxiliary connector is suitable for miniaturization. An opening 24 opens sideways at a position on the auxiliary housing 20 behind the locking 22, and a retainer 26 is coupled to the rear edge of the opening 24 via a hinge 25.

Figure 4:
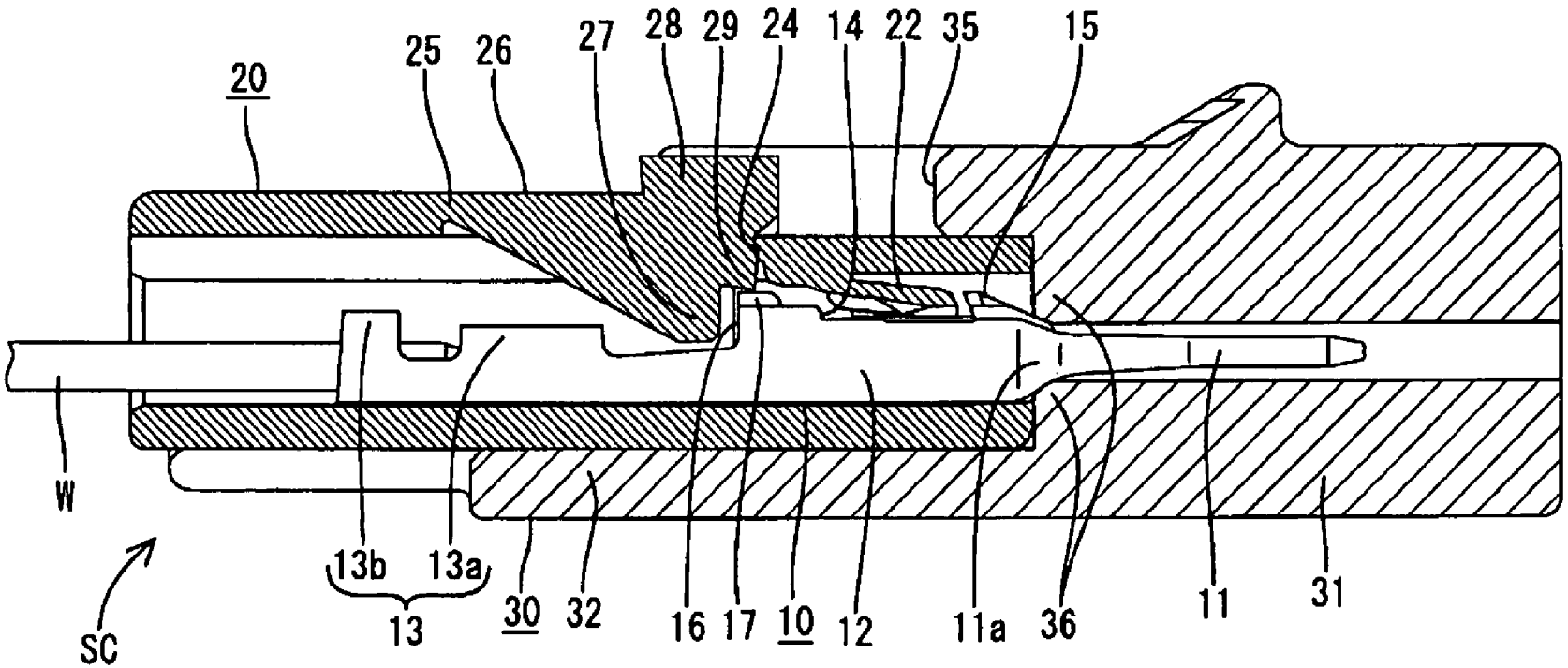
FIG. 4 is a side view in section showing a state where a retainer is pushed to a closing position.

The retainer 26 can rotate about the hinge 25 for opening and closing the opening 24. A terminal lock 27 is provided on the inner surface of the retainer 26 and projects into the cavity 21 for engaging the male terminal fitting 10 when the retainer 26 is at a closing position (FIG. 4). Thus, the terminal lock 27 cooperates with the lock 22 for holding the male terminal fitting 10 so as not to come out backward. The rear surface of the terminal lock 27 is slanted. However, the front surface of the terminal lock 27 faces and engages the male terminal fitting 10 at a position before the two front crimping pieces 13*a* of the barrel 13 when the retainer 26 is at the closing position. A frame locking portion 28 is provided on the outer surface of the retainer 26 and projects out beyond the outer surface of the rear part of the auxiliary housing 20 at the closing position for engaging the frame 40. The outer surface of the retainer 26 is substantially flush with the outer surface of the rear part of the auxiliary housing 20 when the retainer 26 is at the closing position. Further, a retainer holding portion 29 is provided before the terminal lock 27 of the retainer 26 and engages the front inner edge of the opening 24 to hold the retainer 26 at the closing position. The retainer holding portion 29 also presses the protrusion 17 of the male terminal fitting 10 from the outer side at the closing position.

The protection cap 30 is made e.g. of a synthetic resin and is hollow along forward and backward directions. The protection cap 30 includes a tab protecting portion 31 for surrounding and protecting the tab 11 of the male terminal fitting 10. The protection cap 30 also includes an auxiliary housing accommodating portion 32 into which the auxiliary housing 20 is insertable from behind. The tab protecting portion 31 and the auxiliary housing accommodating portion 32 are coupled one after the other. Resilient pieces 33 are cantilevered from opposite sides of the rear end of the auxiliary housing accommodating portion 32, and a holding projection 34 is provided on the inner surface of each resilient piece 33. The holding projection 34 is engageable with a holdable portion (not shown) on an outer surface of the auxiliary housing 20 that has been inserted to a proper depth into the protection cap 30 to hold the auxiliary housing 20 so as not to come out backward. A notch 35 is formed in an outer wall of the auxiliary housing accommodating portion 32 at a side corresponding to the retainer 26 for permitting entry of the retainer 26.

Front-stops 36 bulge in from the inner surfaces of the tab protecting portion 31 to engage the front end surface of the auxiliary housing 20 that has been inserted to the proper depth and to hold the auxiliary housing 20 at its front end position. The front-stops 36 bulge more inward than the inner peripheral surfaces of the cavity 21 in the auxiliary housing 20. Thus, the male terminal fitting 10 also is stopped at its front end position. More specifically, the front-stops 36 engage the base end 11*a* of the tab 11 projecting forward from the cavity 21 when the male terminal fitting 10 is inserted substantially to the proper depth in the cavity 21 with the protection cap 30 mounted on the auxiliary housing 20. Accordingly, the male terminal fitting 10 cannot move forward from the proper insertion position. Contact surfaces 36*a* of the front-stops 36 with the tab 11 are slanted or rounded at substantially the same shape as the outer surfaces of the base end 11*a* of the tab 11.

Figure 5:
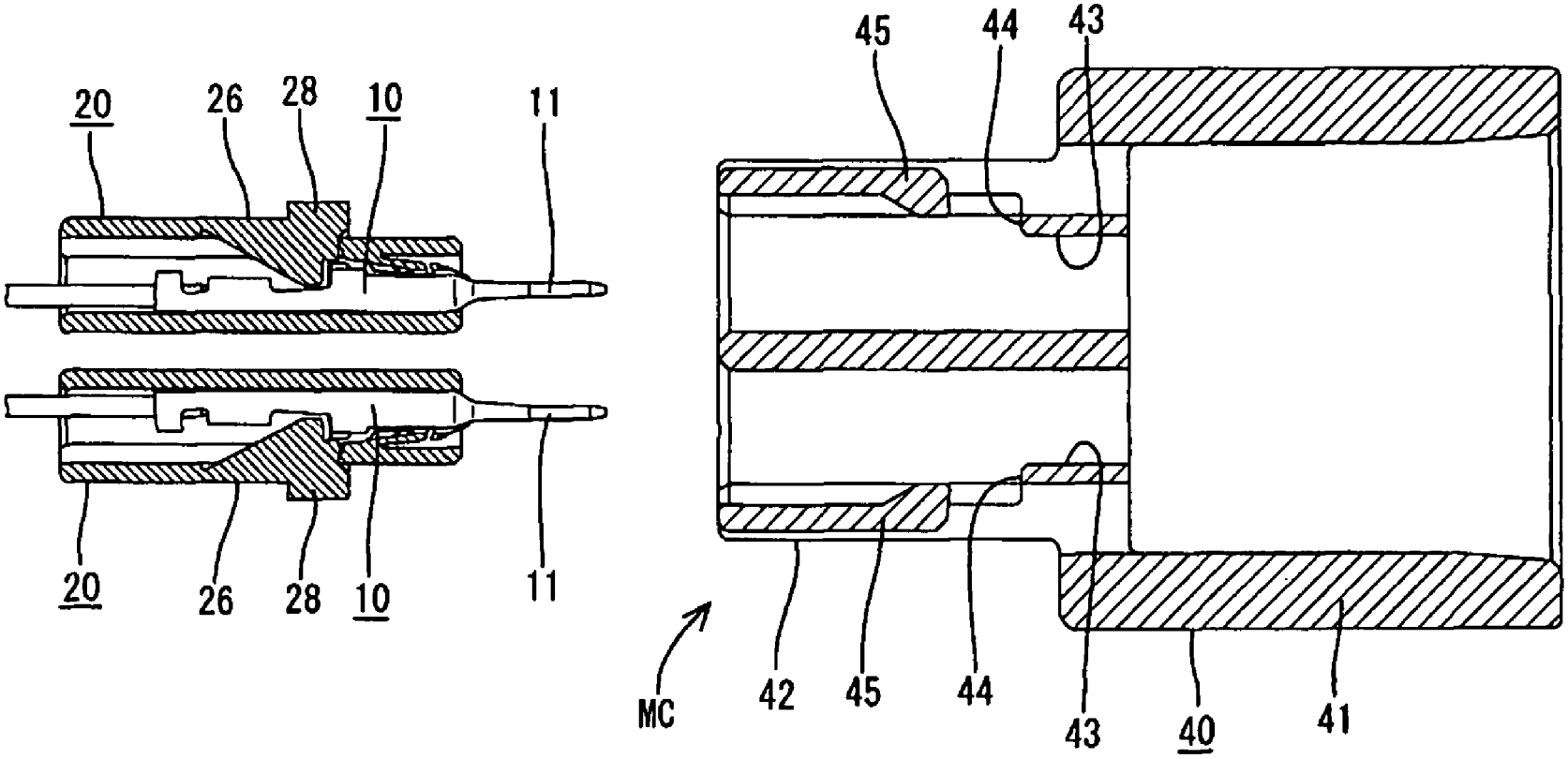
FIG. 5 is an exploded side sectional view of the auxiliary housings mounted into a frame.

The frame 40 is made e.g. of a synthetic resin and defines a substantially rectangular tubular receptacle 41 and a substantially lattice-shaped frame main body 42 coupled one after the other as shown in FIG. 5. The female divided connector FC is fittable into the receptacle 41 from a mating side or front and can be held fitted by an unillustrated locking means.

Figure 6:
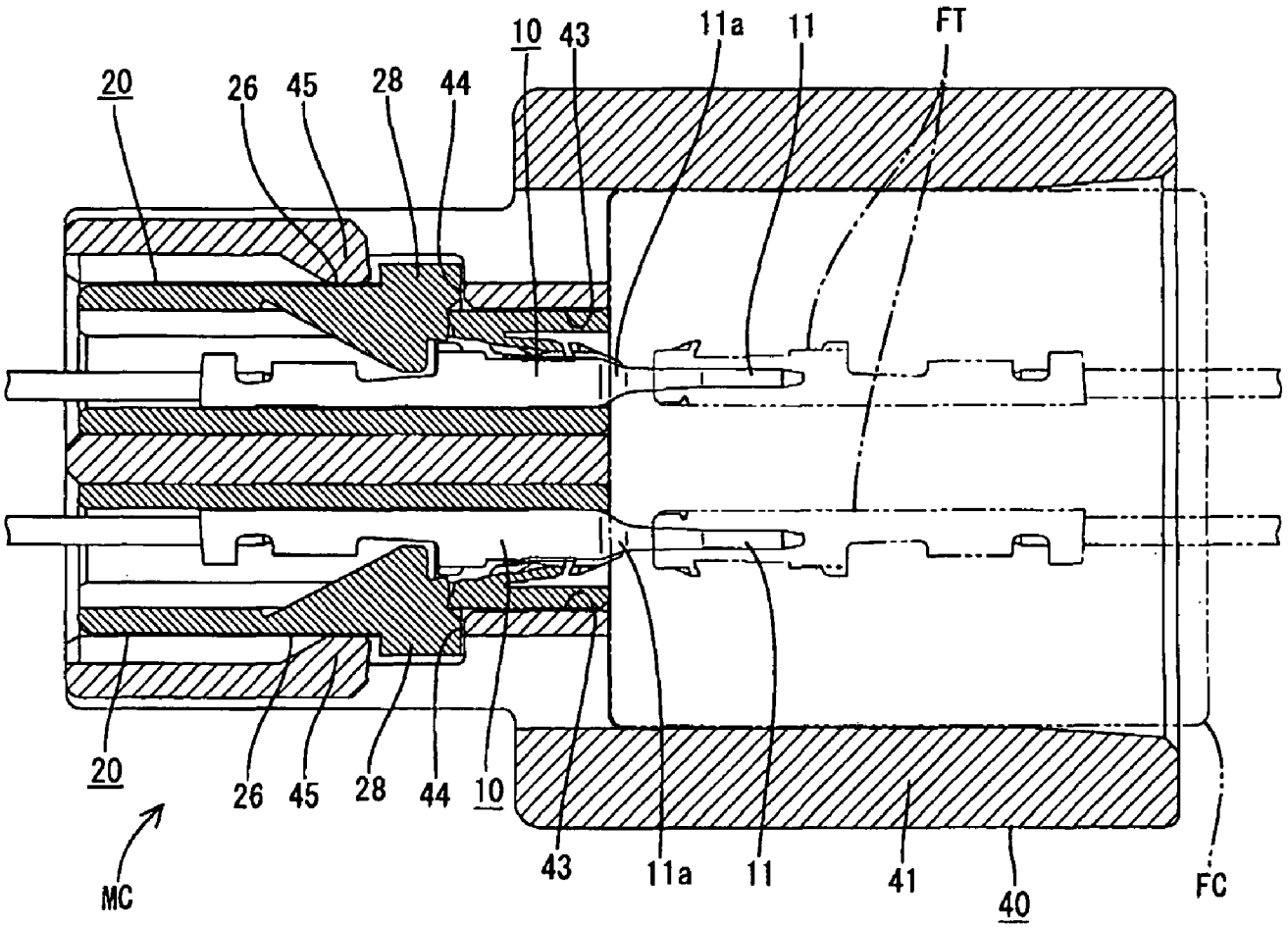
FIG. 6 is a side view in section showing a state where the auxiliary housings are mounted in the frame.

Accommodating chambers 43 are arranged one over the other in the frame main body 42 and the auxiliary housings 20 are insertable into the accommodating chambers 43 from behind as shown in FIGS. 5 and 6. An opening 44 is formed in an outer wall of the each accommodating chamber 43 substantially corresponding to the retainer 26, and a resilient holding piece 45 is cantilevered forward from the rear edge of the opening 44. The resilient holding piece 45 engages the frame locking portion 28 of the retainer 26 of the auxiliary housing 20 and prevents the auxiliary housing 20 that has been inserted to the proper depth from coming out backward. The retainer 26 of the auxiliary housing 20 that reaches the proper depth contacts the front edge of the opening 44 to hold the auxiliary housing 20 at its front end position.

The female divided connector FC has auxiliary housings (not shown) that accommodate the female terminal fittings FT. The auxiliary housings then are mounted into a frame (not shown), and are fit into the receptacle 41 (see phantom line in FIG. 6).

Figure 2:
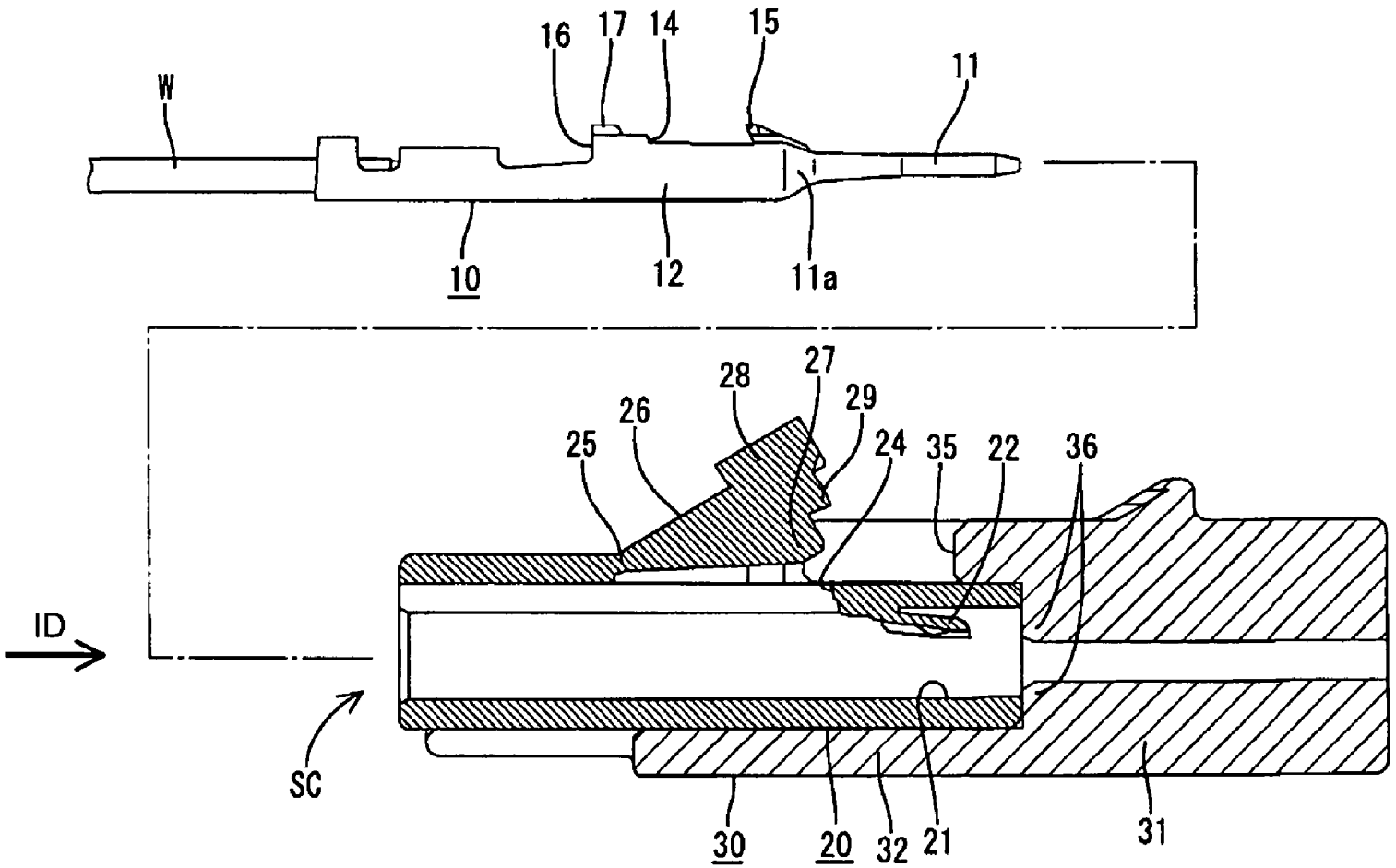
FIG. 2 is a side view in section showing a state where a protection cap is mounted on an auxiliary housing.

The auxiliary housings 20 are inserted into the auxiliary housing accommodating portion 32 of the respective protection caps 30 from a state shown in FIG. 1. In this inserting process, the holding projections 34 move onto the outer side surfaces of the auxiliary housing 20, so that the resilient pieces 33 deform outward. The resilient pieces 33 restore resiliently when the auxiliary housing 20 is inserted to the proper depth so that the holding projections 34 engage the holdable portions. Additionally, the front-stops 36 engage the front end surface of the auxiliary housing 20 when the auxiliary housing 20 is inserted to the proper depth, as shown in FIG. 2. As a result that the auxiliary housing 20 cannot move forward or back from the proper mount position.

Figure 3:
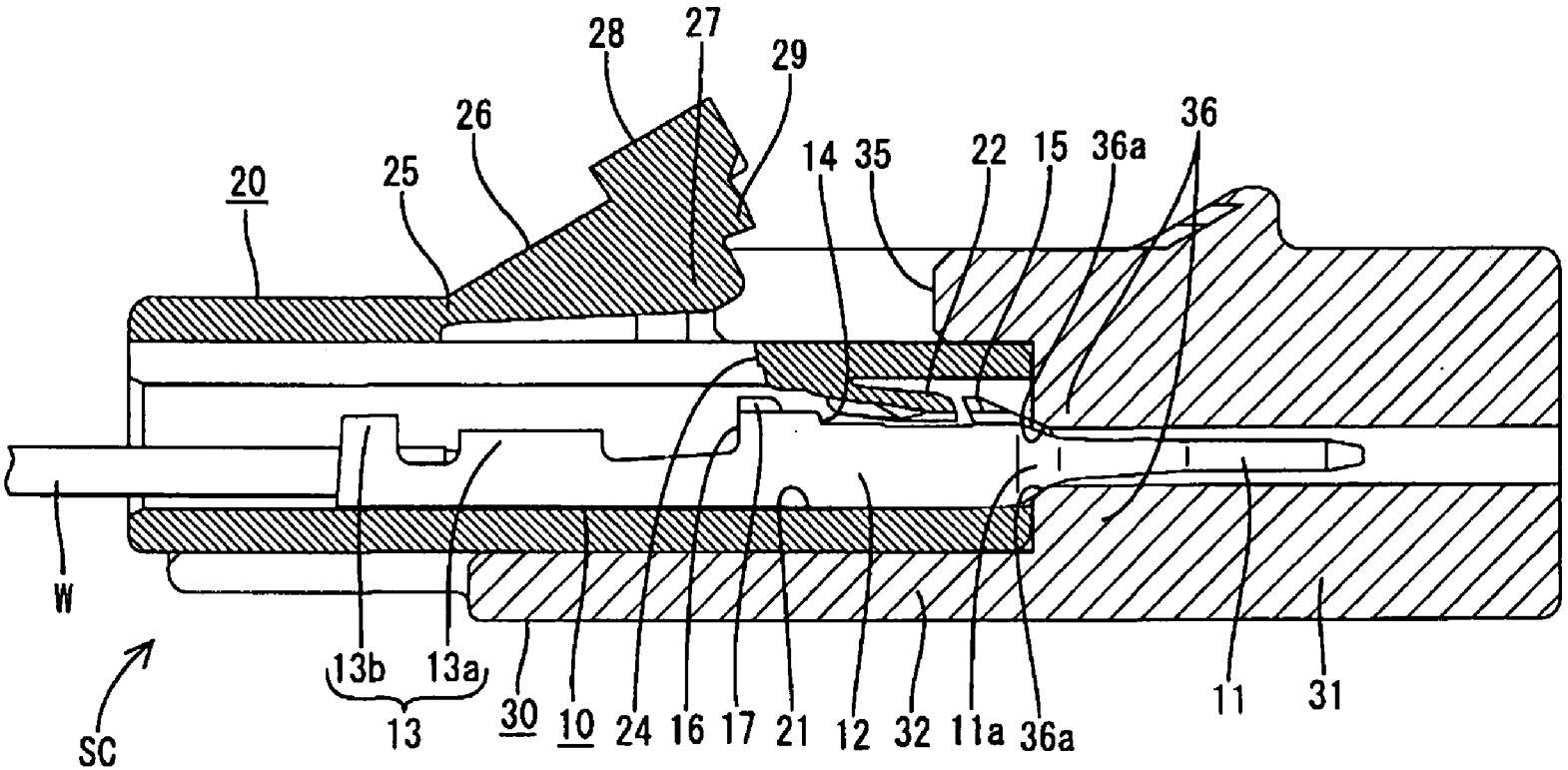
FIG. 3 is a side view in section showing a state where a male terminal fitting is inserted in a cavity.

Each male terminal fitting 10 is inserted into the respective auxiliary housing 20 so that the tab 11 projects forward from the cavity 21 and into the respective tab protecting portion 31. The lock 22 is deformed as the male terminal fitting 10 is inserted, but is restored resiliently when the male terminal fitting 10 reaches the proper depth. Thus, the lock 22 enters the recess 14 and engages both the front edge of the recess 14 and the locking projection 15, as shown in FIG. 3, to prevent the male terminal fitting 10 from coming out backward. Simultaneously, the base end 11*a* of the tab 11 projects forward of the cavity 21 and engages the front-stops 36 to prevent the male terminal fitting 10 from being pushed forward in the inserting direction ID from the proper insertion position.

The retainer 26 then is pivoted about the hinge 25 to move from the opened state towards the opening 24. The terminal lock 27 enters the cavity 21 when the retainer 26 reaches the closing position and engages the locking step 16 and the protrusion 17 of the male terminal fitting 10, as shown in FIG. 4. At this time, the retainer holding portion 29 engages the inner front edge of the opening 24 to hold the retainer 26 at the closing position. Further, the retainer holding portion 29 presses the protrusion 17 from outer side. The frame locking portion 28 is located in the notch 35 of the protection cap 30 and does not project out from the protection cap 30.

The completely assembled cap-fitted auxiliary connector SC is packed in a bag, container or the like and is transported to a site for assembly with the frame 40. The tab 11 is surrounded and protected by the tab protecting portion 31 during transportation. Thus, the tab 11 will not interfere other cap-fitted auxiliary connectors SC, and deformation of the tab 11 is prevented.

The protecting caps 30 are detached from the auxiliary housings 20 after transportation to the assembly site and the auxiliary housings 20 are mounted into the frame 40 as shown in FIG. 5. More particularly, the two auxiliary housings 20 arranged back-to-back so that the retainers 26 thereof face in opposite directions. The auxiliary housings 20 then are inserted into the first and second accommodating chambers 43 of the frame 40 from behind. The resilient locking pieces 45 deform outward in the process of inserting the auxiliary housings 20. However, the resilient holding pieces 45 are restored resiliently when the auxiliary housings 20 reach the proper depth. Thus, the front surfaces of the resilient holding pieces 45 engage the rear surfaces of the frame locking portions 28 and the front surfaces of the frame locking portions 28 engage the front edges of the openings 44, as shown in FIG. 6. As a result, the auxiliary housings 20 are prevented from moving forward or back from their proper insertion positions. At this time, the tabs 11 of the male terminal fittings 10 project into the receptacle 41.

The front stop 36 of the protection cap 30 does not stop male terminal filling 10 at its front end position after the protection cap 30 is detached from the auxiliary housing 20. However, the terminal lock 27 of the retainer 26 engages the front crimping pieces 13*a* of the barrel portion 13 and the rear edge of the lock 22 engages both the rear edge of the recess 14 and the front surface of the locking projection 15. Thus, the male terminal fitting 10 will not come forward out of the auxiliary housing 20 even if a forward-acting force is exerted on the male terminal fitting 10 after the protection cap 30 is removed.

The female divided connector FC is fit into the receptacle 41 of the completely assembled male divided connector MC to connect the male terminal fittings 10 and the female terminal fittings FT electrically, as shown in phantom in FIG. 6. The male terminal fittings 10 are for a normal connector, and hence the tabs are shorter than the tabs of normal male terminal fittings for a divided connector. However, the male terminal fittings 10 are held at more forward positions than the male terminal fittings for a divided connector by a length sufficient to compensate for the difference in the length. Accordingly, areas of contact sufficient to hold the terminal fittings 10, FT satisfactorily connected can be ensured even if shaking occurs along forward and backward directions between the auxiliary housings 20 and the frame 40. In a connected state, the male terminal fittings 10 are held at their front end positions by having the base ends 11*a* of the tabs 11 supported by the front surface of the female divided connector FC.

As described above, the front-stops in the protection cap 30 engage the male terminal fitting 10 when the male terminal fitting 10 is inserted into the cavity 21 with the protection cap 30 mounted on the auxiliary housing 20. Thus, the male terminal fitting 10 cannot move forward from the proper insertion position. The tabs 11 of the male terminal fittings 10 for a normal connector are shorter than tabs of male terminal fittings for a divided connector. Thus, it is difficult for the auxiliary housings 20 to stop these male terminal fittings 10 at their front end positions because the insertion positions of the male terminal fittings 10 are more forward. However, the male terminal fittings 10 of the subject invention can be stopped at their front end position during insertion even when used in the divided male connector MC.

Further, even if the protection cap 30 is detached from the auxiliary housing 20 after the insertion of the male terminal fitting 10, the male terminal fitting 10 is engaged with the lock 22 and/or the terminal lock 27 of the retainer 26, thereby being prevented from coming out forward.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shape and the number of the front-stops can be set arbitrarily.

Although the lock and the retainer are used as auxiliary front-stops in the foregoing embodiment, auxiliary front-stops separate from the lock and the retainer may be provided in conformity with the shape of the male terminal fitting. It is also possible to omit the auxiliary front-stops.

The protection cap is not limited to the one having a tubular tab protecting portion and may have a bag-shaped tab protecting portion having an open rear end and a closed front end according to the present invention. Further, a plurality of auxiliary housings may be accommodated into one protection cap according to the present invention.

What is claimed is:

1. A cap-fitted auxiliary connector for a divided connector having a plurality of auxiliary housings mounted in a frame, the auxiliary housings having male terminal fittings provided with tabs inserted therein, the cap-fitted auxiliary connector having a protection cap mounted on the auxiliary housings for at least partly surrounding and protecting the tabs, wherein the protection cap comprises front-stops for engaging the male terminal fittings inserted into the auxiliary housings to hold the male terminal fittings at proper insertion positions so as not to move any further forward.

2. The cap-fitted auxiliary connector of claim 1, wherein each auxiliary housing comprises an auxiliary front-stop for engaging the male terminal fitting to prevent the male terminal fitting from coming out forward.

3. The cap-fitted auxiliary connector of claim 1, wherein the cap comprises at least one holding projection engageable with the auxiliary housing inserted to a substantially proper depth into the protection cap to hold the auxiliary housing so as not to come out.

4. The cap-fitted auxiliary connector of claim 1, wherein the auxiliary housing has a retainer for locking the male terminal fittings in the auxiliary housing so as not to come out.

5. The cap-fitted auxiliary connector of claim 4, wherein a notch is formed in the protection cap at a side corresponding to the retainer for permitting entrance of the retainer.

6. The cap-fitted auxiliary connector of claim 1, wherein the male terminal fitting is accommodated in a cavity in the auxiliary housing and the front-stops bulge more inward than inner peripheral surfaces of the cavity in the auxiliary housing for stopping the male terminal fitting at the proper insertion position.

7. The cap-fitted auxiliary connector of claim 1, wherein the male terminal fitting comprises a main portion behind the tab with respect to an inserting direction, a base end of the tab being formed to gradually increase in at least one cross-sectional dimension toward the main portion.

8. The cap-fitted auxiliary connector of claim 7, wherein front-stop portions is engaged with outer surfaces of the base end.

9. The cap-fitted auxiliary connector of claim 8, wherein front-stops have shapes substantially conforming to outer surfaces of the base end.

10. A method of assembling a cap-fitted auxiliary connector for a divided connector, comprising the following steps:

providing a plurality of auxiliary housings to be at least partly mounted into a frame;

mounting a protection cap onto at least part of the auxiliary housings; and inserting male terminal fittings provided with tabs into the auxiliary housings so that the protection cap at least partly surrounds and protects the tabs;

wherein the male terminal fittings are held at proper insertion positions so as not to move any further forward by engaging at least one front-stop on the protection cap.

11. The method of claim 10, wherein the male terminal fitting is engaged by an auxiliary front-stop portion on the auxiliary housing to prevent the male terminal fitting from coming out forward.

* * * * *